US007416324B1

(12) United States Patent
Tessnow et al.

(10) Patent No.: US 7,416,324 B1
(45) Date of Patent: Aug. 26, 2008

(54) MULTI-COLOR OR MULTI-FUNCTION LED VEHICLE LIGHT ASSEMBLY

(75) Inventors: Thomas Tessnow, Weare, NH (US); Charles Coushaine, Rindge, NH (US); Howard Eng, Hancock, NH (US); Michael Tucker, Henniker, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/158,545

(22) Filed: Jun. 22, 2005

(51) Int. Cl.
*F21S 8/10* (2006.01)

(52) U.S. Cl. ..... 362/545; 362/511; 362/521; 362/522; 362/800

(58) Field of Classification Search ..... 362/511, 362/509, 545, 555, 240, 560, 580, 800, 516–518
See application file for complete search history.

(56) References Cited

U.S. PATENT DOCUMENTS 6,530,683 B1 * 3/2003 Ohkohdo et al. ..... 362/511
7,275,839 B2 * 10/2007 Coushaine et al. ..... 362/231
2003/0227774 A1 * 12/2003 Martin et al. ..... 362/240
2004/0037088 A1 * 2/2004 English et al. ..... 362/545
2004/0156211 A1 8/2004 Blusseau
2004/0252517 A1 12/2004 Ishida

FOREIGN PATENT DOCUMENTS

EP 1 371 901 12/2003

* cited by examiner

*Primary Examiner*—Stephen F Husar
*Assistant Examiner*—Jessica L McMillan
(74) *Attorney, Agent, or Firm*—William E. Meyer

(57) ABSTRACT

A vehicle light assembly may be made from a lamp having a plurality of LED light sources arrayed circumferentially around the lamp; a reflector body having a reflector axis generally directed to a field to be illuminated. A plurality of reflective surfaces is formed on the front side, the respective reflective surfaces separated by one or more axially extending walls. A through passage is formed in the reflector body, sized and shaped to receive a portion of the lamp, and intersecting a planar extension of at least one of the axially extending walls separating a first reflective surface from a second reflective surface. The planar extension intersects the lamp between a first LED and a second LED whereby light form the first LED substantially shines toward the first reflective surface and the light from the second LED shines toward the second reflective surface.

6 Claims, 4 Drawing Sheets

MULTI-COLOR OR MULTI-FUNCTION LED VEHICLE LIGHT ASSEMBLY

BACKGROUND OF THE INVENTION

1. Field of the Invention

The invention relates to electric lamps and particularly to automotive electric lamps. More particularly the invention is concerned with automotive LED lamp assemblies.

2. Description of the Related Art Including Information Disclosed Under 37 CFR 1.97 and 1.98

Vehicle manufacturers are rapidly adopting light emitting diodes (LEDs) as light sources for use in vehicles. LEDs offer various advantages over incandescent lamps, and in particular they can be mounted in relatively thinner packages, requiring for example less of the trunk volume to accommodate the lamp depth. Making lamps smaller is not a completely good thing. Signal lamps must be visually distinguishable so an observer can mentally separate the intended messages. With incandescent lamps, this is achieved by spacing them sufficiently far apart so the differing signals visually do not overlap or bleed into each other. LED lamps can also be separated, but LED lamps can be relatively more expensive, and multiple lamps may not be economic. There is then a need for a lamp system that uses LEDs, but provides distinguishable regions of illumination on a vehicle.

BRIEF SUMMARY OF THE INVENTION

A vehicle light assembly may be made from a lamp having a plurality of LED light sources arrayed circumferentially around the lamp; a reflector body having a reflector axis generally directed to a field to be illuminated. A plurality of reflective surfaces is formed on the front side, the respective reflective surfaces separated by one or more axially extending walls. A through passage is formed in the reflector body, sized and shaped to receive a portion of the lamp, and intersecting a planar extension of at least one of the axially extending walls separating a first reflective surface from a second reflective surface. The planar extension intersects the lamp between a first LED and a second LED whereby light from the first LED substantially shines toward the first reflective surface and the light from the second LED shines toward the second reflective surface.

DETAILED DESCRIPTION OF THE INVENTION

Figure 1:
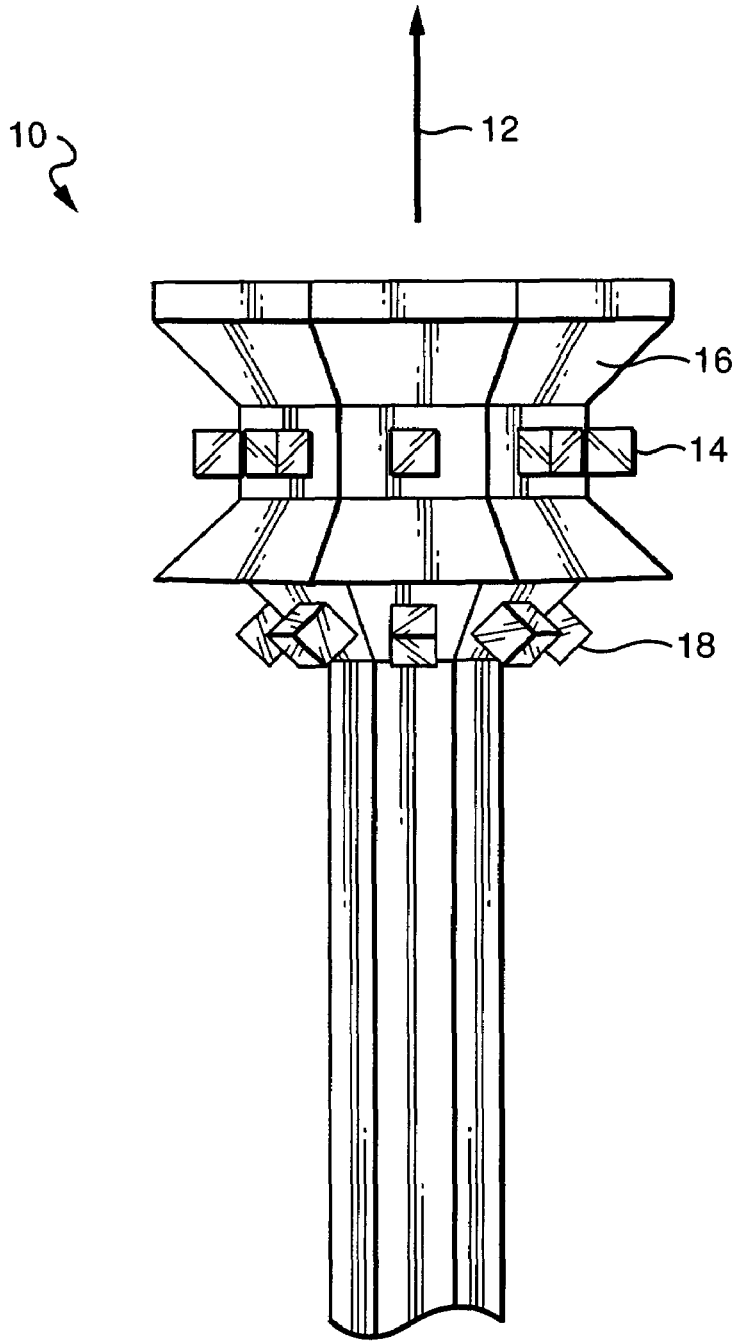
FIG. 1 shows the distal end of an LED lamp.

FIG. 1 shows the distal end of an LED lamp 10. The LED lamp comprises a base with mechanical coupling for the lamp and electrical connection to power the LEDs as known in the art. The lamp 10 may have any, convenient mechanical base and electrical connection as known in the art. A bayonet coupling with a plug socket connection is acceptable. The lamp 10 extends in an axial direction 12 to a distal end. Arrayed around the distal end is a plurality of LEDs 14. In the preferred embodiment the LEDs 14 are arrayed as a ring around the axis 12 and preferably spaced equal angularly around the axis 12. Each LED may be associated with one or more adjacent optically reflecting surfaces 16 directing light received from the LED 14 in a direction generally away from the axis 12. There may be one or more additional rings 18 of LEDs.

Figure 2:
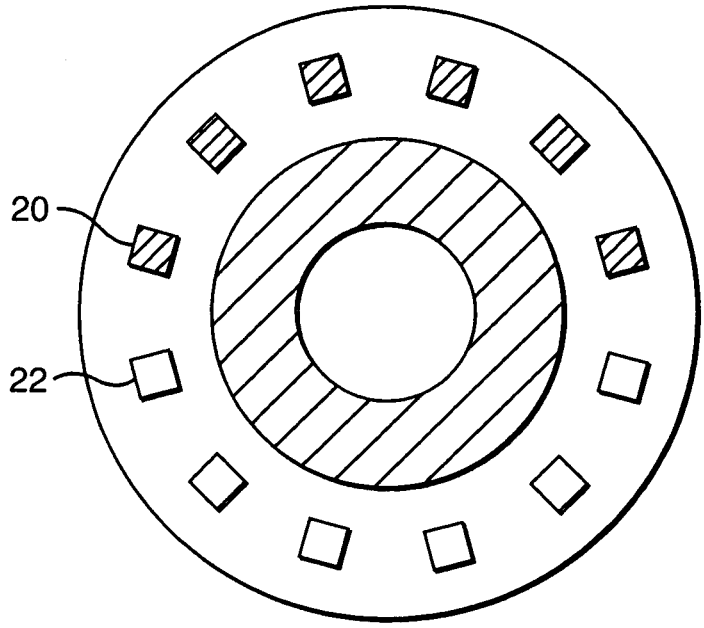
FIG. 2 shows a schematic cross sectional view of a ring of LEDs.

FIG. 2 shows a schematic cross sectional view of a ring of LEDs. The LEDs comprises at least two separate sets. A first set 20 may be arrayed around the axis in a first angular segment, and a second set 22 may be arrayed around the axis in the remaining angular segment. The first set 20 may additionally provide a first color, and the second set 22 may provide a second color. For example the first set may be arrayed between 1 to 180 degrees around the axis and provide a red color, and the second set may be arrayed between 180 to 360 degrees around the axis and provide a white color. The first set 20 of LEDs may be electrically coupled to light up as a group; while the second set 22 are similarly electrically coupled to light up separately as a group.

Figure 3:
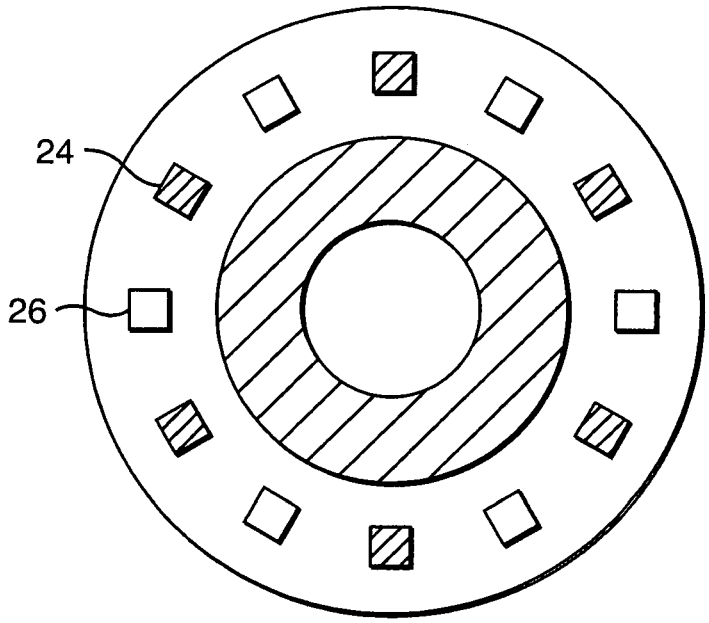
FIG. 3 shows an alternative schematic cross sectional view of a ring of LEDs.

FIG. 3 shows an alternative cross sectional schematic view of a ring of LEDs. The LEDs may additionally arrayed in alternating patterns, with one or more LEDs of a first type 24, for example red LEDs, stationed next to one or more LEDs of a second type 26, for example white LEDs in an alternating pattern. It is understood there may one or more LEDs in each grouping of the first set (sets of plural red LEDs alternating with sets of plural white LEDs) and there may be two or more types of LEDs in the alternating pattern, for example an alternation of red, white and amber colored LEDs. Again the sets of LEDs of a common color may be electrically coupled to light up as a group.

Figure 4:
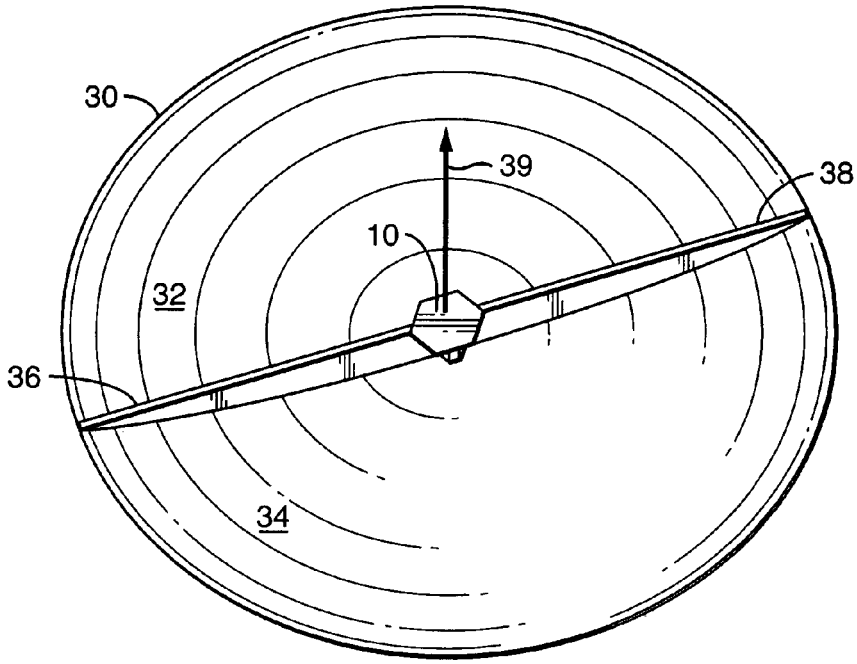
FIG. 4 shows a schematic lamp and reflector assembly.

FIG. 4 shows a schematic lamp 10 and reflector 30 assembly. The lamp 10 is surrounded by a reflector 30, so the light emitted by the LED lamp reflects from reflective surfaces making up the reflector 30 to a field of view. In the preferred embodiment the reflector 30 has at least one first reflective region 32 optically associated with the first set of LEDs (such as set 20) and at least one second reflective region 34 optically associated with the second set of LEDs (such as set 22). Preferably, intermediate the first reflective region 32 and the second reflective region 34 is an axially extending wall or walls 36, 38 separating the first reflective region 32 and the second reflective region 34. The reflector 30 is formed with a through passage to accommodate insertion of the lamp 10. The through passage is preferably positioned with respect to ends of the walls 36, 38, so that the wall ends are aligned intermediate sets of LEDs supported on the distal lamp end. Each set of LEDs is then aligned between respective walls to illuminate only the proper respective sections of the reflector. For example, when the lamp 10 is properly positioned in the through passage and rotationally aligned with respect to the respective walls 36, 38, the first set of LEDs 20 face only region 32, and the second set of LEDs 22 face only region 34. In this way light emitted from the first set of LEDs 20 is reflected to the field of view only by the first reflective region 32 and does not bleed into or otherwise illuminate the second reflective region 34. Similarly, the second set of LEDs 22 is reflected to the field of view only by the second reflective region 34 and does not bleed into or otherwise illuminate the first reflective region 32.

Figure 5:
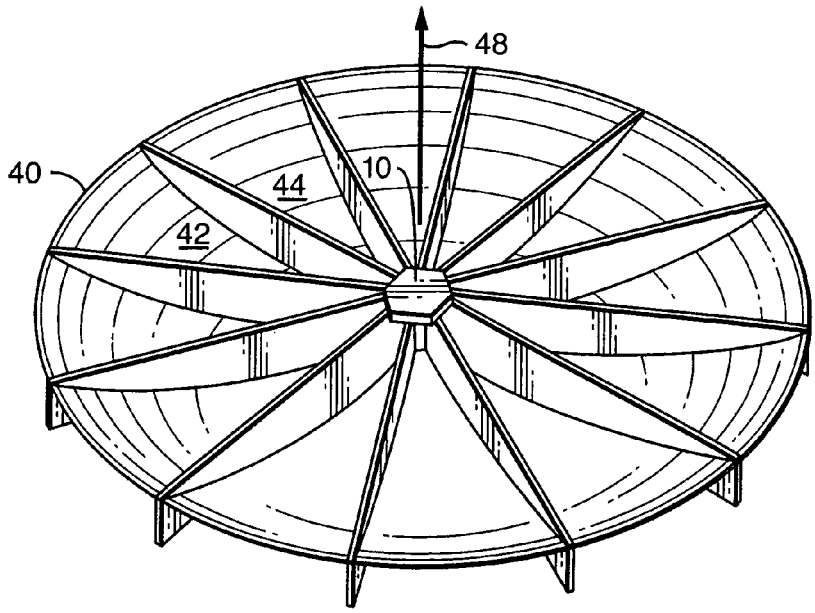
FIG. 5 shows an alternative schematic lamp and reflector assembly.

FIG. 5 shows an alternative lamp and reflector assembly. Correspondingly, the reflector 40 may be divided into a plurality of alternating reflective regions 42, 44 and so forth extending as so many segments extending around the lamp 10 centered in the reflector 40. Associated with each respective set of LEDs of FIG. 3 (24, 26 etc.) is a corresponding reflective region of FIG. 5 (42, 44, etc.) whereby light from only the respective set of LEDs shines onto and is reflected by the corresponding reflective region.

Figure 6:
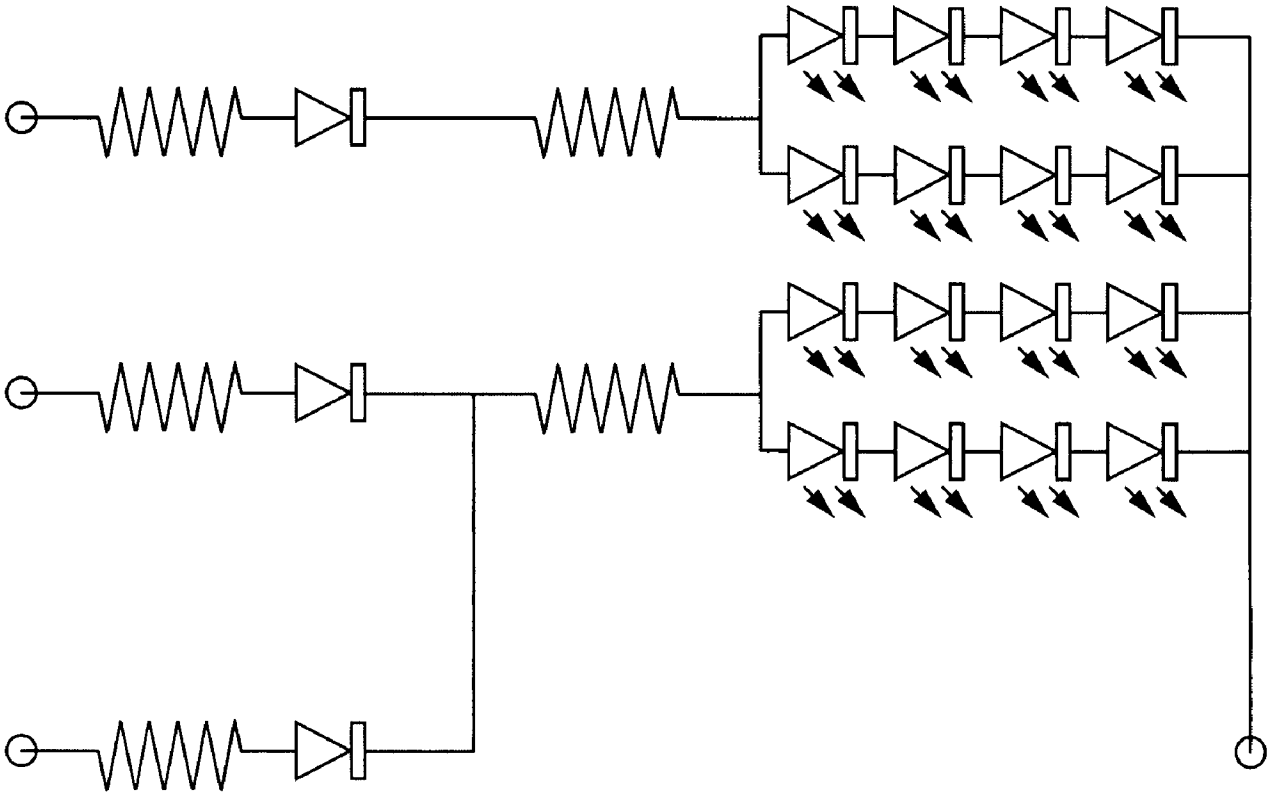
FIG. 6 shows a control circuit for an LED lamp.

FIG. 6 shows a control circuit for an LED lamp. The driving circuitry for the lamp can be structured to activate separately selected LED sets. For example, the first set of LEDs may be selected, or the second set of LEDs may be selected, or combinations thereof. In this way, one LED lamp may be used to provide all of the plurality of signaling features (red, amber and white) required for a vehicle tail lamp, while the visual images of the generated signals do not blend or overlap so as to be diminished or confused by an observer.

A bayonet coupling between the reflector and lamp is preferred, but the coupling may be threaded, clipped, frictional, glued or similarly accomplished. The base may also include an electrical socket to receive an electrical connection to supply power for the LEDs. Electrical circuitry may also be included in the assembly, for example circuitry for voltage or current adjustment, temperature compensation, voltage or current safety control, switching means and so on may be included. It is known in the art that dispersing heat from the LEDs improves the LED performance and life, and that copper or similar high heat conductive materials may be used advantageously in the construction of an LED lamp to conduct heat from the LEDs to an exterior heat sink, such as an exposed metal disk or heat conductive metal fins.

The reflector body has a reflector axis extending from a backside of the reflector body to a front side of the reflector body, and is also generally directed to the field to be illuminated. The front side of the reflector is divided into a plurality of reflective surfaces. The reflective surfaces are separated by one or more walls that extend in one direction in the reflector axis direction. The walls are preferably as thin as possible to maximize the reflective surface areas, and at the same time light impermeable so light shone onto on reflective surface does not bleed into a second reflective surface. The reflector body also includes a defined through passage extending from the backside to the front side. The through passage is sized and shaped to receive at least a portion of the lamp 10, so the lamp 10 may be inserted through the through passage from the backside to expose the LEDs, on the distal end 36 on the front side of the reflector body. Light from the LEDs, may be then shone on the respective reflective surfaces. The preferred through passage is also positioned to intersect at least one and preferably a plurality of planar extensions axially extend from the walls separating the reflective surfaces. Restated, the preferred separating walls radiate away from the defined passage. The walls then divide the space on the front side of the reflector body, around the through passage where the lamp 10 is exposed into compartmentalized volumes. A first wall then separates a first reflective surface from a second reflective surface, and so on. In the preferred embodiment, the planar extensions of the separating walls intersect the lamp 10 between where adjacent sets of the LEDs, are located. A planar extension of a first wall them separates at least a first LED and at least a second LED whereby light from the first LED substantially shines toward the first reflective surface and light from the second LED shines toward the second reflective surface and an intermediate wall acts as a block between the reflector surfaces. Similarly other wall sections may separate the light emitted from other sets of LEDs and permits that respective light to be shone only a corresponding reflective surface. There may be one or more LEDs in any of the sets of LEDs whose light is directed to a particular reflective surface. Two or more LEDs may then be associate with the lighting of a particular reflective surface, but not with other reflective surfaces. In general, LEDS providing a first color combination illuminate a first set of reflective surfaces, while LEDs providing a second color combination illuminate a different set of reflective surfaces. The variously reflective surfaces may otherwise be allocated in a variety fashions around the through passage. One preferred embodiment is to divide the reflector body into equal angular sections around the through passage, as equal pie slices radiating from the central located through passage. In the preferred embodiment the reflector body is made from a molded plastic with the general form of a dish divided by on or more vertical walls diving the dish into compartments that open onto a common through passage. It is understood that the various compartments need only receive light from the respective sets of LEDs, so the compartments may be exposed via an open window or via a light transmissive window adjacent the respective LEDs.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A vehicle light assembly comprising:

a single lamp having a distal end and a plurality of LED light sources arrayed circumferentially around the distal end;

a reflector body having a reflector axis extending from a back side of the reflector body to a front side of the reflector body generally directed to a field to be illuminated, a plurality of reflective surfaces formed on the front side of the reflector body, the respective surfaces separated by one or more axially extending walls, and a through passage formed in the reflector body, sized and shaped to receive at least a portion of the lamp, intersecting a planar extension of at least one of the axially extending walls separating a first reflective surface from a second reflective surface, the planar extension intersecting the lamp between at least a first LED and at least a second LED whereby light from the first LED substantially shines toward the first reflective surface and the light from the second LED substantially shines toward the second reflective surface.

2. The lamp assembly in claim 1, wherein the reflective body is divided between a first reflective surface and a second reflective surface by a respective intermediate axially extending wall, and the lamp includes one or more LEDs of a first color directed to the first reflective body and one or more LED of a second color directed to the second reflective surface.

3. The lamp assembly in claim 1, wherein the reflective body is divided between a first set of reflective surfaces and a second set of reflective surfaces by a respective intermediate axially extending wall, and the lamp includes one or more sets of LEDs of a first color directed to the first set of reflective surfaces and a second set of LEDs of a second color directed to the second set of reflective surfaces.

4. The lamp assembly in claim 1, wherein the through passage is formed in a central surface of the reflector body and a plurality of axial extending walls radiate from the through passage towards a circumferential edge of the reflector body dividing the reflector body into a plurality of reflective surfaces.

5. The lamp assembly in claim 1, wherein the plurality of walls forms similar angles between adjacent walls.

6. The lamp assembly in claim 1, wherein the lamp includes a base end, an extended middle section extending from the base end along a lamp axis to a distal end and the LEDs are circumferentially arrayed around a portion of the distal end.

* * * * *